US005360369A

United States Patent [19]

Larsson et al.

[11] Patent Number: 5,360,369

[45] Date of Patent: Nov. 1, 1994

[54] CHANGE MACHINE

[75] Inventors: Stig B. Larsson, Mosman; Ian M. Ryan, Double Bay, both of Australia

[73] Assignee: Scandic International Pty. Ltd., Alexandria, Australia

[21] Appl. No.: 938,258

[22] PCT Filed: Apr. 26, 1991

[86] PCT No.: PCT/AU91/00163

§ 371 Date: Dec. 2, 1992

§ 102(e) Date: Dec. 2, 1992

[87] PCT Pub. No.: WO91/17526

PCT Pub. Date: Nov. 14, 1991

[30] Foreign Application Priority Data

Apr. 27, 1990 [AU] Australia ..... PJ 9864

[51] Int. Cl.[5] ..... G07D 1/02; G07D 9/04

[52] U.S. Cl. ..... 453/19; 222/547; 453/30

[58] Field of Search ..... 453/19, 20, 32, 33, 453/34, 35, 63, 30; 222/547, 564; 221/312 R, 202

[56] References Cited

U.S. PATENT DOCUMENTS

| | | | |
|---|---|---|---|
| 1,935,012 | 11/1933 | Brandt | 453/19 X |
| 3,680,566 | 8/1972 | Tanaka et al. | 453/32 X |
| 3,690,332 | 9/1972 | Dykehouse et al. . | |
| 3,768,616 | 10/1973 | Dykehouse et al. . | |
| 4,059,122 | 11/1977 | Kinoshita | 453/33 X |
| 4,441,515 | 4/1984 | Goepner | 453/32 |
| 4,635,661 | 1/1987 | Uematsu et al. | 453/20 X |
| 4,669,638 | 6/1987 | Peleus | 222/547 X |

FOREIGN PATENT DOCUMENTS

| | | | |
|---|---|---|---|
| 8574982 | 1/1983 | Australia . | |
| 1406283 | 11/1983 | Australia . | |
| 2148983 | 5/1984 | Australia . | |
| 7537081 | 4/1985 | Australia . | |
| 1904210 | 8/1970 | Germany . | |
| 1615071 | 12/1990 | U.S.S.R. | 222/564 |

*Primary Examiner*—F. J. Bartuska
*Attorney, Agent, or Firm*—Richard C. Litman

[57] ABSTRACT

A dispensing device utilises a bulk dispensing receptacle (2) used in combination with a dispensing hopper (1) to dispense coins, tokens or other items to an outlet tray (4) of a change or vending machine. The bulk dispensing apparatus being adapted to be filled to a predetermined number of coins, tokens or items when the change or vending machine is not being used by a user. Additionally an extension bin (3) for gravity feed of coins, tokens and items into the hoppers may be used having inclined walls and a baffle device to prevent "bridging" of coins, tokens and items. The dispensing device is quick in dispensing coins or tokens by filling the bulk dispensing receptacle (2) whilst information is being inputted by a user.

15 Claims, 3 Drawing Sheets

CHANGE MACHINE

TECHNICAL FIELD

The present invention relates to improvements within a currency change machine. Whilst the invention is according to one embodiment directed towards and is primarily described with reference to a bulk payment apparatus for a currency change machine which dispenses coins or tokens, it is anticipated that the invention is suitable for use with other dispensing machines such as for confectionery or other dispensed items.

BACKGROUND

A currency change machine typically comprises an acceptor device, a central processing unit (CPU) and one or more payout hoppers. The accepting device is generally a coin, note or card acceptor, which validates a coin, note or card being inserted into the machine and issues a signal to the CPU which in turn signals the payout hopper to pay out coins or tokens.

Typically payout hoppers are slow in counting out and dispensing the required payout. In existing machines attempts have been made to increase the speed of payouts by increasing the number of payout hoppers within the machines. Besides being costly this also leads to the physical size of the machine being drastically increased. For many applications the size, in particular the horizontal size of a change machine is critical. Generally large change machines are undesirable in their places of intended use.

Additional problems arise as increasing the number of payout hoppers naturally leads to increasing the quantity of coins the accumulated number of hoppers are able to hold in reserve for future payouts. To further increase the hopper capacity vertical extensions of the hopper container have been provided.

The coins are paid out from the bottom of the hopper and the hoppers are filled from the top. Due to this fact, the practically managable distance from the bottom of the hopper to the top of the hopper or extension is limited, as the height at which the coins are paid out to the user must not be too low, and the height at which the hopper is filled must not be too high as service personnel must be able to easily fill the hopper with coins. Whilst for these reasons horizontal as well as vertical extension of the hopper container capacity is preferable, this has not been done as coinage does not transport as would liquid, and if the hopper container is extended horizontally as well as vertically, this may cause "bridging" where coins force themselves into a high compression area, and thus block in that position, due to the weight of the coinage above.

Furthermore, due to the weight of coins, a hopper with a large extension is very difficult to handle if full of coins, should there be a need to remove the hopper for reasons such as emptying the hopper or removing a faulty hopper.

DISCLOSURE OF INVENTION

The fundamental purpose of the present invention is to provide a device to ameliorate the payout performance of currency change machines and vending machines by utilising a bulk dispensing receptacle in combination with a dispensing hopper in order to reduce the period of dispensing times.

In one broad form the present invention comprises a bulk dispensing apparatus for the dispensing of items such as coins, tokens, confectionery and the like from a machine upon receipt of a signal from a control means, said bulk dispensing apparatus comprising:

at least one hopper for the counting out and dispensing of items, at least one bulk dispensing receptacle adapted to be filled with a predetermined number of items from said hopper, and an outlet tray at or near said hopper and said bulk dispensing receptacle, wherein in use when said machine is required to dispense a number of items less than the predetermined number of items in said bulk dispensing receptacle, said items are dispensed from said dispense hopper into said outlet tray, and wherein in use when the machine is required to dispense a number of items equal to the predetermined number of items in said bulk dispensing receptacle, said predetermined number of items are dispensed from said bulk dispensing receptacle into said outlet tray, and wherein in use the machine is required to dispense a number of items greater than the predetermined number of items in said bulk dispensing receptacle, said predetermined number of items is dispensed from said bulk dispensing receptacle into said outlet tray and the balance of said number of items, required, are dispensed from the hopper into said outlet tray.

In another form the present invention comprises a bulk dispensing apparatus for the dispensing of items such as coins, tokens, confectionery and the like from a machine upon receipt of a signal from a control means, said bulk dispensing apparatus comprising:

a plurality of hoppers each of which is for the counting out and dispensing of items.

a plurality of bulk dispensing receptacles, each of which is adapted to be filled with a predetermined number of items from one of said hoppers, and an outlet tray at or near said hoppers and said bulk dispensing receptacles, wherein, in use, when said machine is required to dispense a number of items less than the smallest predetermined number of items held by one of said bulk dispensing receptacles, said items are dispensed from one of said hoppers into said outlet tray, and wherein, in use, the machine is required to dispense a number of items equal to the predetermined number of items in any one of said bulk dispensing receptacles, said items are dispensed directly from the said one bulk dispensing receptacle into said outlet tray, and wherein, in use, the machine is required to dispense a number of items equal to the sum of the predetermined numbers of items of two or more said bulk dispensing receptacles, said items are dispensed directly from said two or more bulk dispensing receptacles into said outlet tray, and wherein, in use, the machine is required to dispense a number of items not equal to any one of the predetermined numbers of items or the sum thereof, and is greater than the smallest predetermined number of items held by one of said bulk dispensing receptacles, then the items are dispensed by dispensing the items from one or more of said bulk dispensing receptacles, the balance of said number of items dispensed from one of said hoppers directly into said outlet tray.

In another form the present invention comprises a bulk payout apparatus for the dispensing of coins from a currency change machine upon receipt of a payout signal from a control means, said bulk payout apparatus comprising:

at least one payout hopper for the counting out and dispensing of coins, at least one bulk payout receptacle adapted to be filled with a first predetermined number of coins from said payout hopper, and a coin outlet tray at or near said payout hopper and said bulk payout receptacle, wherein in use when said currency change machine is required to payout a number of coins less than the first predetermined number of coins in said bulk payout receptacle, said coins are dispensed from said payout hopper into said coin outlet tray, and wherein in use the currency change machine is required to payout a number of coins equal to the first predetermined number of coins in said bulk payout receptacle, said first predetermined number of coins are dispensed into said outlet tray, and wherein in use the currency change machine is required to payout a number of coins greater than the first predetermined number of coins in said bulk payout receptacle, said first predetermined number of coins is dispensed from said bulk payout receptacle into said coin outlet tray and the balance of coins dispensed from the payout hopper into said coin outlet tray.

In a further form the present invention comprises an extension bin for the storage of coins or tokens being dispensed by gravity to a payout hopper within a change machine, wherein said extension bin has an opening for the exit of the coins or tokens from said extension bin and entry into said payout hopper and said opening has means for closure such that the coins may be blocked within said extension bin.

The invention will now be described by way of a non-limiting example with reference to the following drawings.

MODE FOR CARRYING OUT INVENTION

Figure 1:
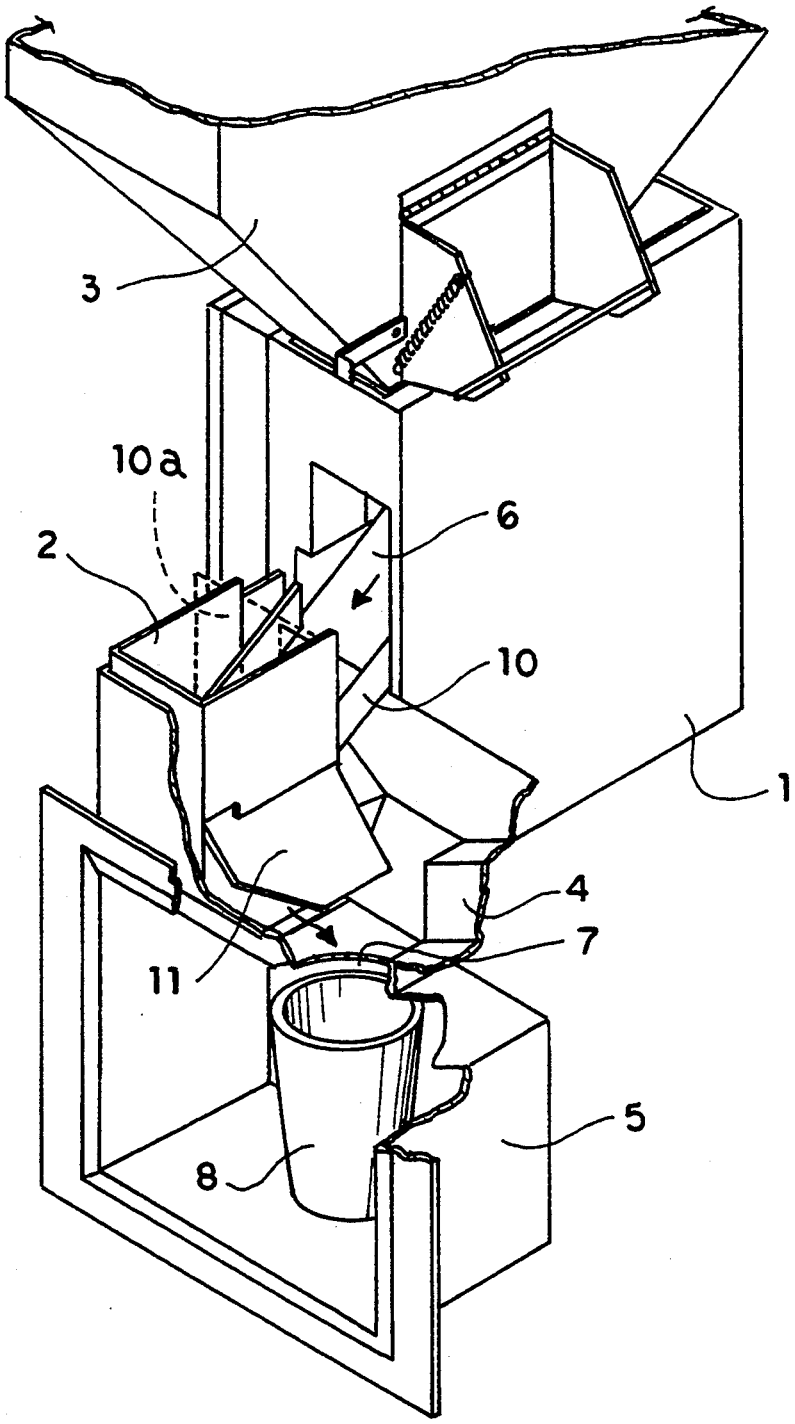
FIG. 1 illustrates a perspective view of the present invention, with the coin out tray and cup holder shown cut away to more easily depict the invention.

In one embodiment of the present invention the money change machine comprises a payout hopper 1, a bulk payout device 2, an extension bin 3, a coin out tray 4 and a cup holder 5, see FIG. 1.

The payout hopper 1 may be any one of the known types of hoppers used for the payout of coins or tokens and may for example be a belt or disc type hopper. The extension bin 3 is a container for the storage of coins and is situated above the payout hopper 1. In use the coins within the extension bin 3 are gravity fed to the payout hopper 1. The payout hopper 1 has a coin exit opening 6 which allows for the dispensing of coins to the coin out tray 4 and to the bulk payout device 2 which are both situated near the coin exit opening 6. The coin out tray 4 has an opening 7 in its lower region leading to cup holder 5. The coin out tray 4, cup holder 5 and opening 7 shown cut away to show cup 8 able to be positioned within the cup holder 5 and positioned under the opening 7.

The bulk payout device 2 is a receptacle means having a fill door 10 pivotally connected on the side facing the coin exit opening 6 and an empty door 11 pivotally connected on the side orientated towards opening 7 of the coin out tray 4.

It is possible to fill the bulk payout device 2 with coins being dispensed from the payout hopper 1. In order to fill the bulk payout device 2 the empty door 11 is closed and the fill door 10 is opened. In the open position the fill door 10 acts as a ramp such that coins being dispensed from the payout hopper 1 are directed into the bulk payout device 2. When the fill door 10 is in the closed position (shown in FIG. 1 using broken lines and denoted 10*a*), coins being dispensed from the payout hopper are dispensed into the coin out tray 4 which is shaped such that they fall towards and then through opening 7.

In order to empty the bulk payout device 2 when it is full of coins the empty door 11 is opened and the coins fall towards and through opening 7 of the coin out tray 4.

Increased payout speed from the change machine is achieved by filling the bulk payout device 2 with a predetermined number of coins being dispensed from the payout hopper 1 whilst the machine is idle or is accepting coins, notes or a card from the user.

When a user of the money change machine requires a payout one of three alternatives may occur. They are as follows:

(i) If the required number of coins by the user is less than the number of predetermined coins within the filled bulk payout device 2, then the required number of coins are paid out directly from the payout hopper 1 and dispensed to the cup 8 via the coin out tray 4 and opening 7.

(ii) If the required number of coins by the user is equal to the predetermined number of coins in the bulk payout device 2, the empty door 11 opens and the required number of coins drop into the coin out tray 4 and through opening 7 into cup 8.

(iii) If the required number of coins is larger than the number of coins in the bulk payout device 2, the initial part is paid by dropping the predetermined number of coins from the bulk payout device 2 into the coin out tray 4 and the balance is paid out directly from the payout hopper.

An example is as follows: The coin change machine may have a bulk payout device 2 which holds 50 coins. If a user requires only 20 coins the coins are paid out directly from payout hopper 1. If the user requires 50 coins they would be paid out by emptying the bulk payout device 2. If the user requires 60 coins the bulk payout device 2 containing 50 coins would empty and the balance of 10 coins would be paid out directly from the payout hopper 1.

A money change machine utilising the present invention is preferably controlled such that if at the completion of a payout the bulk payout device 2 has been emptied, the payout hopper will commence filling the bulk payout device 2 to the predetermined number of coins.

By utilising such a money change machine the time taken to dispense large amounts of coins is considerably decreased.

The bulk payout device of the present invention can be configured and controlled such that it can only dispense one predetermined number of coins for the bulk payout device 2 or alternatively a control means may be provided within the change machine in which an authorized person may select a predetermined number of coins to be used in the bulk payout device.

Figure 3:
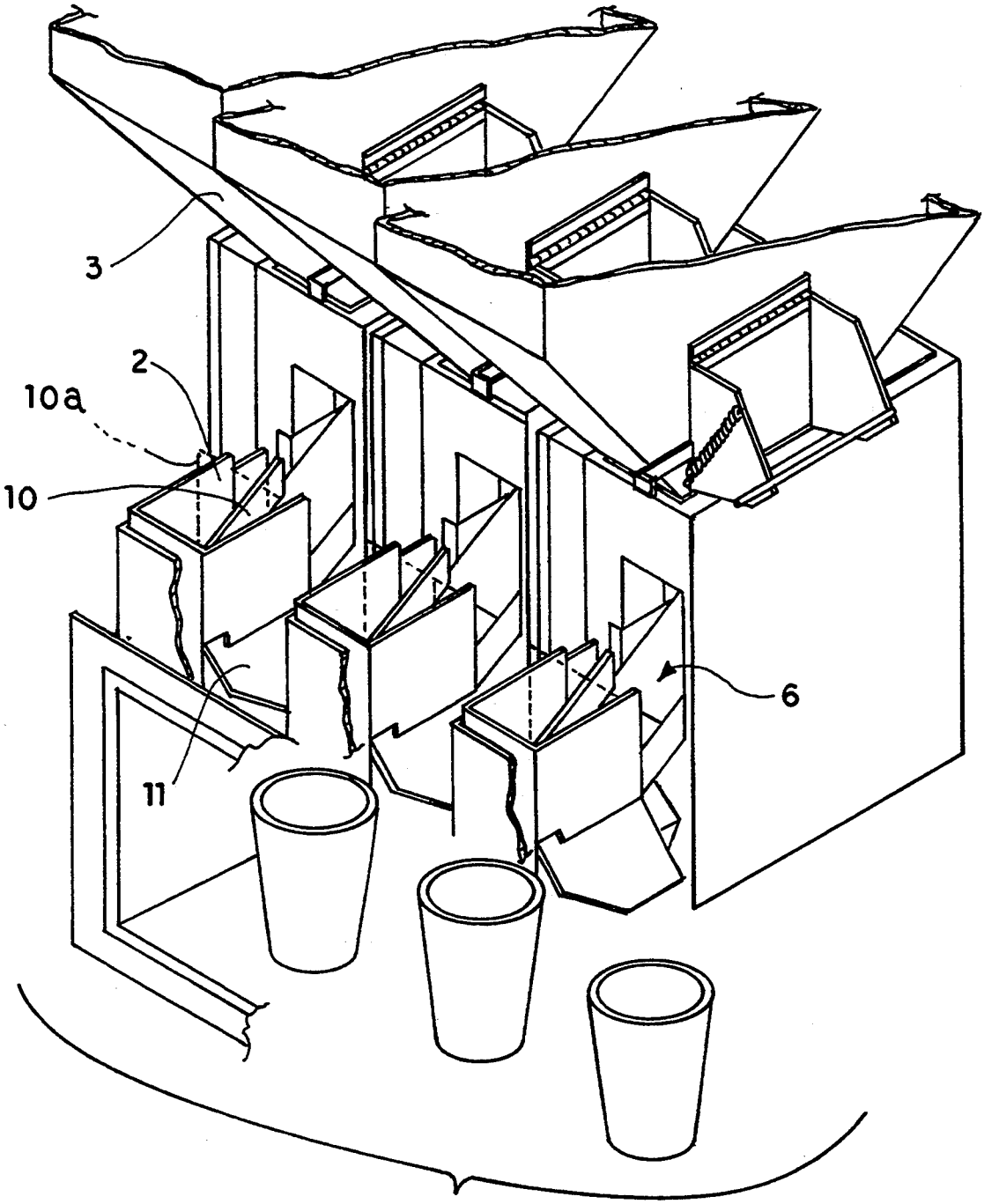
FIG. 3 illustrates a perspective view of a plural structural embodiment of the present invention.

In a further embodiment of the present invention, as illustrated in FIG. 3, a plural structural arrangement of a bulk dispensing apparatus including two or more bulk payout devices may be adapted to be filled by one or more payout hoppers.

For example one configuration may be where one payout hopper is utilised with two bulk payout devices. The first bulk payout device is filled with 25 coins and the second bulk payout device is filled with 50 coins. The machine in such a configuration would payout in the following alternatives:

(i) When payout is less than 25 coins, payout is directly from payout hopper.

(ii) When payout required is equal to 25 coins, payout is directly from first bulk payout device.

(iii) When payout required is from 26 to 49 coins payout is from first bulk payout device and balance from payout hopper.

(iv) When payout required is equal to 50 coins payout is directly from second bulk payout device.

(v) When payout required is from 51 to 74 coins payout is 50 coins from second bulk payout device and the balance of coins from payout hopper.

(vi) When payout required is 75 coins, payout is from both first and second bulk payout devices.

(vii) When payout is 76 coins or more payout is from first and second bulk payout devices combined and balance from payout hopper.

The combination of bulk payout devices with payout hoppers may be configured to suit the intended usage environment in which the change machine will be used i.e food and cigarette vending machine change requirements differ from those used in clubs or casinos where poker machines and other gambling machines are used.

Figure 2:
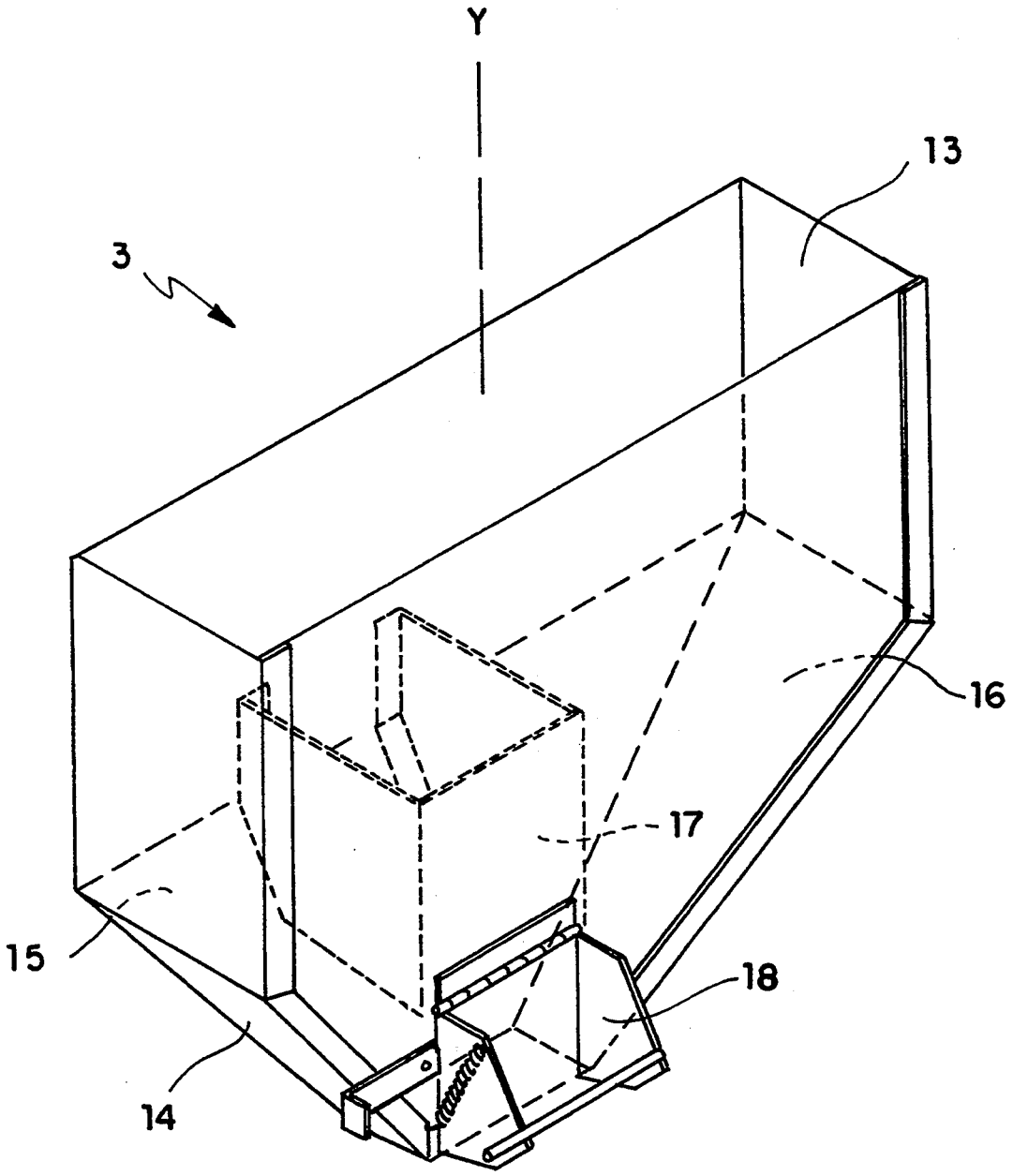
FIG. 2 illustrates the extension bin of the present invention.

In a further aspect of the present invention the extension bin 3 (see FIG. 2) is removably situated above the payout hopper 1 (see FIG. 1) and has an upper section 13 which is rectangular in cross section about vertical axis Y. The lower section of the extension bin 3 has three side walls 14, 15, 16 inclined to the vertical axis Y. The extension bin 3 also has a vertical baffle 17 above the lower opening 18. The positioning of the baffle 17 and the overall shape of the extension bin 3 ensures that coins being stored and gravity fed to the payout hopper 1 below, are unimpeded and move through extension bin 3 in three separate sections, thus dispensing the weight of the coins so that no "bridging" of the coins occurs.

The extension bin 3 is also provided with a cut off door 18 which allows the coins in the extension bin 3 to be isolated from the payout hopper 1. This allows for the payout hopper 1 to be easily removed from the change machine when servicing or inspection is required, without having to remove the extension bin 3. This is a particular advantage as the extension bin 3 is considerably heavy when full of coins.

In further not shown embodiments the baffle, side walls, lower opening and cut off door of the extension bin may be of different shape and configuration.

The present invention therefore provides a bulk payout device which ameliorates the payout speed of a change machine.

In addition the present invention provides an extension bin whose shape and configuration ensures "bridging" of coins does not occur within the container. Further the inclusion of a cut off door allows for the isolation of the extension bin from the payout hopper thus making servicing and inspection of the payout hopper when the change machine is in use a much simpler task.

Whilst the preferred embodiment has been described with reference to coins or tokens being dispensed from a change machine, the present invention may be utilised in poker or slot machines or machines dispensing other items.

It should be obvious to persons skilled in the art that numerous variations and modifications could be made to the method and apparatus of the present invention as described and with reference to the illustrations without departing from the overall scope or spirit of the invention.

We claim:

1. A bulk dispensing apparatus for the dispensing of items from a vending machine, said bulk dispensing apparatus comprising:

an extension bin for the storage of the items, at least one hopper located below said storage bin and having an exit opening, said hopper is adapted for the counting out and dispensing of the items from said exit opening, at least one bulk dispensing receptacle having an exit opening adapted to be selectively filled with a predetermined number of items from said exit opening of said hopper, and an outlet tray adjacent said hopper and said bulk dispensing receptacle and adapted to selectively receive a predetermined number of items from said exit opening of said hopper and the exit opening of said bulk dispensing receptacle, wherein in use when said machine is directed to dispense a number of items less than the predetermined number of items in said bulk dispensing receptacle, said items are dispensed from said dispense hopper into said outlet tray, wherein in use when the machine is directed to dispense a number of items equal to the predetermined number of items in said bulk dispensing receptacle, said predetermined number of items are dispensed from said bulk dispensing receptacle into said outlet tray, and wherein in use the machine is directed to dispense a number of items greater than the predetermined number of items is dispensed from said bulk dispensing receptacle into said outlet tray and the balance of said number of items, required, are dispensed from the hopper into said outlet tray.

2. A bulk dispensing apparatus for the dispensing of items from a vending machine, said bulk dispensing apparatus comprising:

an extension bin for the storage of the items, a plurality of hoppers located below said storage bin and having an exit opening, each of said hoppers is adapted for the counting out and dispensing of the items from said respective exit opening, a plurality of bulk dispensing receptacles, each of which having an exit opening and each of which is adapted to be selectively filled with a predetermined number of items from said respective exit opening of said hoppers, and an outlet tray adjacent said hoppers and said bulk dispensing receptacles and adapted to selectively receive a predetermined number of items from said respective exit opening of said hoppers and each of said exit openings of said bulk dispensing receptacles.

wherein, in use, when said machine is directed to dispense a number of items less than the smallest predetermined number of items held by one of said bulk dispensing receptacles, said items are dispensed from one of said hoppers into said outlet tray, wherein, in use, the machine is directed to dispense a number of items equal to the predetermined number of items in any one of said bulk dispensing receptacles, said items are dispensed directly from the said one bulk dispensing receptacle into said outlet tray, and wherein, in use, the machine is directed to dispense a number of items equal to the sum of the predetermined numbers of items of two or more said bulk dispensing receptacles, said items are dispensed directly from said two or more bulk dispensing receptacles into said outlet tray, and wherein, in use, the machine is directed to dispense a number of items not equal to any one of the predetermined numbers of items or the sum thereof, and is greater than the smallest predetermined number of items held by one of said bulk dispensing receptacles, then the items are dispensed by dispensing the items from one or more of said bulk dispensing receptacles, the balance of said number of items dispensed from one of said hoppers directly into said outlet tray.

3. A bulk dispensing apparatus as claimed in claims 1 or 2 wherein said machine is a currency change machine and said items being dispensed are coins.

4. A bulk dispensing apparatus as claimed in claims 1 or 2 wherein said items being dispensed are confectionery.

5. A bulk dispensing apparatus as claimed in claim 2 wherein each of said hoppers having said exit opening which allows for the dispensing of items into said outlet tray or into at least one of said bulk dispensing receptacles.

6. A bulk dispensing apparatus as claimed in claim 2 wherein when the machine has dispensed a number of items and said machine is not being used by a user, if any one of said bulk dispensing receptacles has been emptied it will be filled with the predetermined number of items from at least one of said hoppers.

7. A bulk dispensing apparatus as claimed in claim 2 wherein each of said bulk dispensing receptacles has an intake means and an emptying means, said intake means comprising a first pivotally connected door which in an open position acts as a chute means such that items being dispensed from one of said hoppers travel along said first pivotally connected door into said bulk dispensing receptacle and said emptying means is a second pivotally connected door which in an open position allows items in said bulk dispensing receptacle to be emptied into said outlet tray.

8. A bulk dispensing apparatus as claimed in claims 1 or 2 wherein said extension bin for the storage of coins and adapted to dispensed therefrom by gravity to said payout hopper within said machine, said extension bin having a lower section comprising at least three side walls inclined to a vertical axis, an opening for the exit of the items from said extension bin and entry into said payout hopper and baffle adjacent said opening.

9. A bulk dispensing apparatus as claimed in claim 8 wherein said opening has means for closure such that the items may be blocked within said extension bin.

10. A bulk dispensing apparatus as claimed in claim 9 wherein said means for closure is a pivotally connected door.

11. A bulk dispensing apparatus as claimed in claim 8 wherein said baffle comprises vertical baffle walls.

12. An apparatus for dispensing coins for use with a vending machine, said apparatus comprising:

an extension bin including a container for the storage of the coins therein;

a payout hopper located below said storage coin container;

said coin storage container having an exit opening located in the lower part thereof;

a payout device located adjacent said payout hopper and operatively associated with said exit opening of said coin storage container;

said payout device including a receptacle for the housing of coins therein;

a coin tray located adjacent said payout hopper and operatively associated with said exit opening of said coin storage container; whereby the coins in said payout hopper are selectively dispensed and gravity fed via said exit opening of said coin storage container to said payout device and said coin tray; and a cup holder located below said payout device and said coin tray;

said payout device having an exit opening in its lower part;

said coin tray having an opening in its lower part; whereby the coins are selectively dispensed and gravity fed via said exit opening of said payout device and said coin tray opening to said cup holder.

13. An apparatus for dispensing coins as claimed in claim 12 said extension bin having a lower section including at least three side walls inclined to a vertical axis and a baffle adjacent said exit opening of said coin storage container for ensuring unimpeded movement of the coins therefrom.

14. An apparatus for dispensing coins as claimed in claim 12 wherein said receptacle of said payout device has a fill door and an empty door, both being pivotally connected to a wall of said receptacle and operatively associated with said exit opening of said payout device; whereby when said empty door is in a closed position and said fill door is in an open position, said fill door acts as a ramp for the counted coins being gravity fed and directed from the payout hopper into said payout device.

15. An apparatus for dispensing coins as claimed in claim 12 wherein said receptacle of said payout device has a fill door and an empty door, both being pivotally connected to a wall of said receptacle and operatively associated with said exit opening of said payout device; whereby when said fill door is in a closed position and said empty door is in an open position, the coins being gravity fed and directed into said coin tray and then falling by gravity through said coin tray opening into said cup holder.

* * * * *